United States Patent [19]

Antikainen et al.

[11] 4,426,257

[45] Jan. 17, 1984

[54] DAMPING SYSTEM FOR A PAPER MACHINE HEADBOX

[75] Inventors: Jukka Antikainen; Osmo Evälahti, both of Karhula; Tapio Waris, Kyminlinna, all of Finland

[73] Assignee: A. Ahlstrom Osakeyhtio, Noormarkku, Finland

[21] Appl. No.: 315,172

[22] Filed: Oct. 26, 1981

[30] Foreign Application Priority Data

Jan. 26, 1981 [FI] Finland ..... 810202

[51] Int. Cl.[3] ..... D21F 1/02

[52] U.S. Cl. ..... 162/336; 162/337; 162/340; 162/343

[58] Field of Search ..... 162/336, 337, 339, 340, 162/343, 380, 216, 212

[56] References Cited

U.S. PATENT DOCUMENTS

| | | | |
|---|---|---|---|
| 3,098,787 | 7/1963 | Sieber | 162/343 |
| 3,400,044 | 9/1968 | Justus | 162/343 |
| 3,725,197 | 4/1973 | Dahl et al. | 162/343 |
| 4,162,189 | 7/1979 | Kirjavainen | 162/343 |
| 4,166,759 | 9/1979 | Kirjavainen | 162/337 |
| 4,202,724 | 5/1980 | Kirjavainen | 162/340 |

*Primary Examiner*—Steve Alvo

*Attorney, Agent, or Firm*—Bucknam and Archer

[57] ABSTRACT

A system for damping the pressure fluctuations in a paper machine headbox. The headbox applying the damping system comprises an equalizing chamber communicating with an air space, this equalizing chamber having an outlet/outlets for a channel/channels leading to the equalizing chamber as well as an inlet/inlets for a channel/channels leaving the equalizing chamber. The outlet chamber is disposed with regard to the inlet channel so, and the cross surfaces of the outlet and inlet channels have been dimensioned so that the jet of stock flowing out of the outlet and expanding divergently falls substantially inside the boundaries of the inlet.

4 Claims, 12 Drawing Figures

DAMPING SYSTEM FOR A PAPER MACHINE HEADBOX

The present invention relates to a system of damping the pressure fluctuations of stock flow in a paper machine headbox which comprises an equalizing chamber connected to an air space, this equalizing chamber having an outlet for a channel leaving the chamber. A somewhat similar headbox has been disclosed in the U.S. Pat. No. 4,166,759.

The use of the air space in question aims at stabilizing the fluctuations in the pressure level occurring in the stock flow before the slice opening. Pressure fluctuations cause variations in the velocity of the outflowing stock, which results in basis weight variations in the formed pulp web. Therefore pressure fluctuations should be dampened in the most effective way.

It is an object of the present invention to provide a damping system of a simple design having a better damping capacity than the known systems. In order to reach these goals, the outlet channel of the headbox equalizing chamber has been so disposed with regard to the inlet channel, and the cross surfaces of the outlet and inlet channels have been dimensioned so that the jet of stock flowing out of the outlet of the inlet channel and expanding "expanding divergently through an angle of approximately 15°" falls substantially inside the boundaries of the inlet of the outlet channel. It has been found that the ejector effect which is thereby caused by the jet of stock flowing into the outlet channel decreases the pressure in the air space of the equalizing chamber. When the pressure of the air space is low, the surface of the liquid can move in the air space easily without counterforces. The pressure fluctuations occurring in the system are thus dampened due to the changes in the liquid volume.

The invention is described more in detail in the following drawings.

Figure 1:
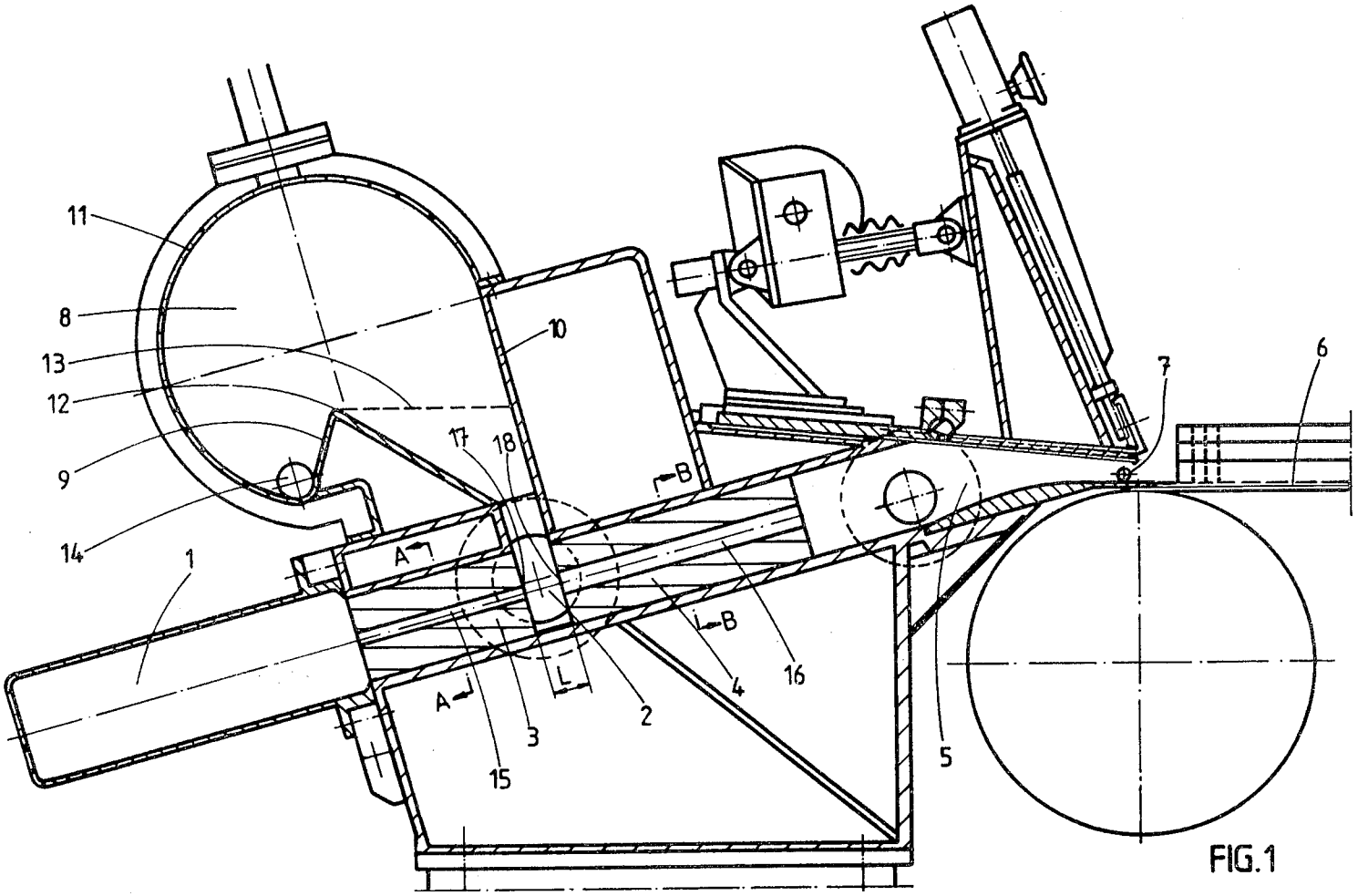
FIG. 1 is a cross-sectional view in machine direction illustrating a headbox applying a damping system according to the present invention.

In FIG. 1, there is a cross header 1, from which the pulp stock flows crosswise to a set of channels 3 leading to an equalizing chamber 2, which is in the machine direction. In the flow direction, after the equalizing chamber there is a set of channels 4 which lead the pulp stock to the lip channel 5, from where the pulp stock flows onto a forming wire 6 through an adjustable slice opening 7. The equalizing chamber communicates with an air space 8 which is limited by walls 9 and 10 of the equalizing chamber and by a housing 11. In the equalizing chamber, there is an overflow weir 12 which determines the liquid surface

13. The pulp stock flown over the weir 12 is discharged from the equalizing chamber through an overflow pipe 14.

Figure 2:
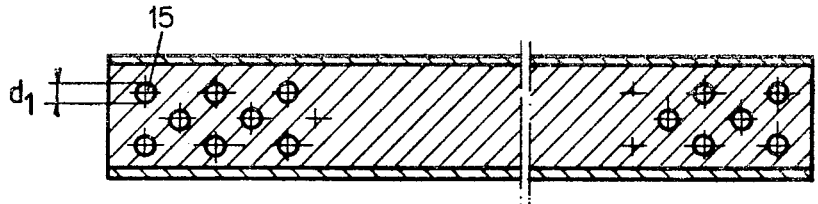
FIG. 2 is a sectional view taken along line A—A of FIG. 1.
Figure 3:
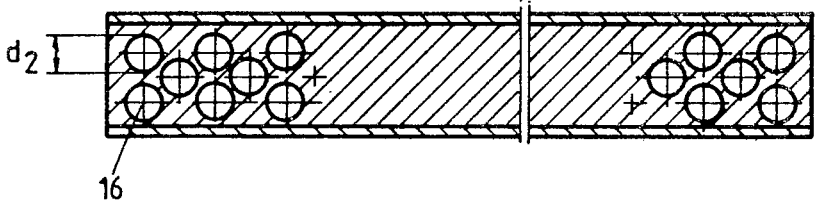
FIG. 3 is a sectional view taken along line B—B of FIG. 1.

In the embodiment illustrated in FIGS. 2 and 3 the set of channels 3 leading to the equalizing chamber consists of a plurality of parallel inlet channels 15 having a round cross-section and a diameter $d_1$, and the set of channels 4 leaving the equalizing chamber consists of outlet channels 16 which are coaxial with regard to the inlet channels and have a round cross-section and a diameter $d_2$. The outlet 17 of the inlet channel is disposed at such a distance L from the inlet 18 of the outlet channel that $$\frac{d_2 - d_1}{2L} > \tan 7.5°.$$

Thus the stock flowing out of the outlet and expanding approximately 15° falls substantially inside the boundaries of the inlet and thereby creates the desired ejector effect.

Figure 4:
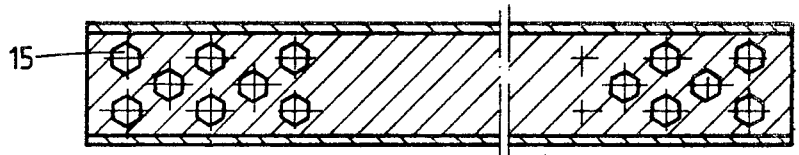
FIGS. 4, 6 and 8 show some alternative forms of section A—A.
Figure 5:
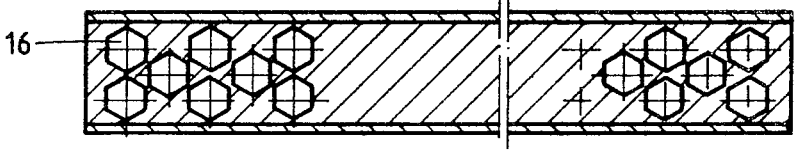
FIGS. 5, 7 and 9 show some alternative forms of section B—B.
Figure 6:
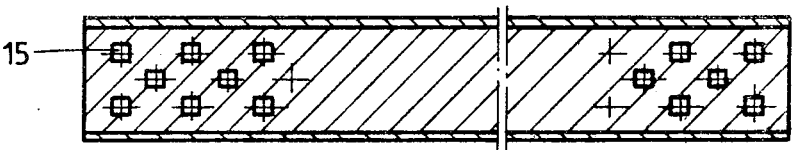
Figure 7:
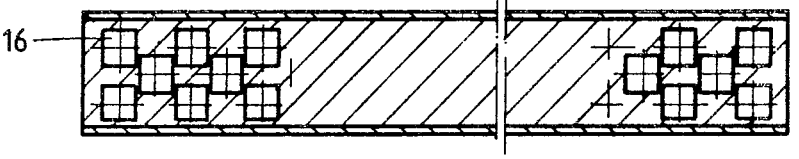

The cross-sections of the inlet and outlet channels 15 and 16 can be quadratic, as shown in FIGS. 4 and 5, or hexagonal, as shown in FIGS. 6 and 7, or of the shape of some other polygon. A round outlet channel can be combined to a quadratic inlet channel. Other kinds of combinations are possible as well.

Figure 8:
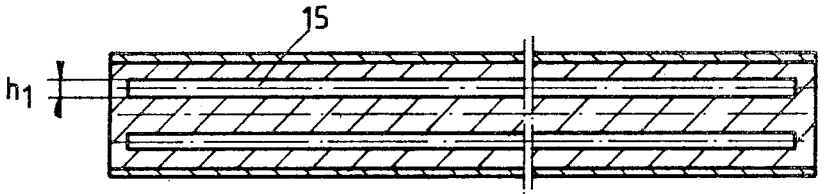
Figure 9:
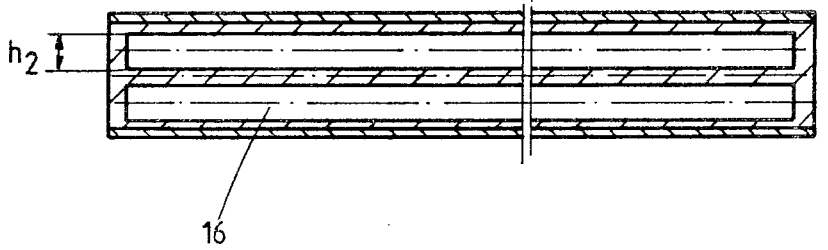

In the embodiment shown in FIGS. 8 and 9 the entire pulp stock is conducted to the equalizing chamber through one rectangular inlet channel of the width of the machine and the height of which is $h_1$. Accordingly, the pulp stock is conducted from the equalizing chamber to the lip channel through only one rectangular outlet channel which is of the same width and disposed coaxially with regard to the inlet channel. The height of the outlet channel is dimensioned in comparison with the inlet 18 of the outlet channel that $$\frac{h_2 - h_1}{2L} > \tan 7.5°.$$

Also other than the above channel systems are possible. Thus, the inlet channels according to FIG. 2 can be combined to the outlet channel according to FIG. 9.

EXAMPLE

A headbox according to FIGS. 1, 2 and 3 in which $d_1$ was 14 mm and $d_2$ 38 mm.

When L was 60 mm, or $$\arctan \frac{d_2 - d_1}{2L} = \arctan \frac{38 - 14}{2 \times 60} = 11.3° > 7.5°,$$

the pressure in the lip channel was 25 kPa and the pressure in the equalizing chamber 15 kPa, i.e. 10 kPa lower than in the lip channel.

When L was increased 200 mm, or $$\arctan \frac{d_2 - d_1}{2L} = \arctan \frac{38 - 14}{2 \times 200} = 3.4° < 7.5°,$$

the pressure in the equalizing chamber was as high as in the lip channel.

The former distance, i.e. 60 mm, was in the tests found to be considerably more advantageous than the latter. Pressure measurings show that the smaller L is, the more effectively are the low frequency disturbances dampened.

When the equalizing chamber operates in the desired way, the jet of stock flowing through the chamber falls substantially inside the boundaries of the inlet opening of the outlet channel. Therefore it is advantageous for the flow that the outlet channel is as big as possible, in practise even as big as there is room for.

Other factors, which are mostly connected to the behaviour of the fibres, require a high flow velocity or sudden changes in the velocity in the outlet channel, in other words the outlet channel must therefore be as small as possible, so that the pulp stock could retain a turbulent condition which breaks down the fibre bundles.

In order to satisfy these conradicting requirements set on the size of the outlet channel, the outlet channel should be made of two or three parts, the first of these being a wide channel part which is then followed by a throttling part of a narrowed part of the channel.

Figure 10:
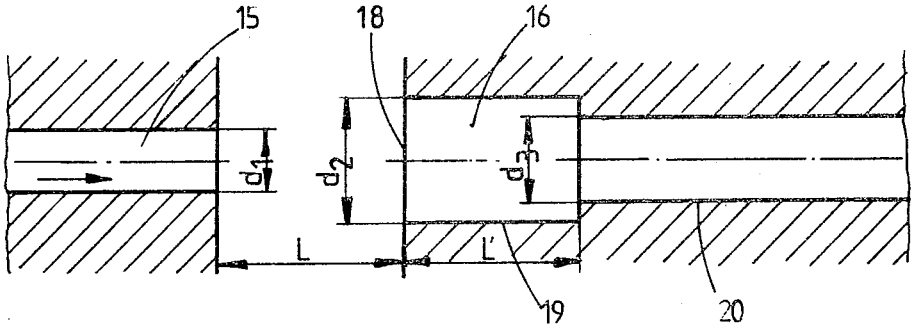
FIG. 10 shows a cross-sectional view in machine direction of an alternative form of the outlet channel.

In FIG. 10, the outlet channel 16 is disposed in relation to the inlet channel 15 having a round cross-section the diameter of which is $d_1$, so that the jet of stock flowing out of the channel 15 and thereby expanding approximately 15°, falls substantially inside the boundaries of the inlet 18 of the channel 16. The channel 16 consists of a first part 19 having a diameter $d_2$, which is followed by a second part 20 having a smaller diameter $d_3$. In order to ensure that the jet of stock flowing out of the channel 15 strikes the wall surface of the first part of the channel before it reaches the second part, the length L′ of the first part must be such that $$\frac{d_2 - d_1}{2(L + L')} < \tan 7.5°.$$

Figure 11:
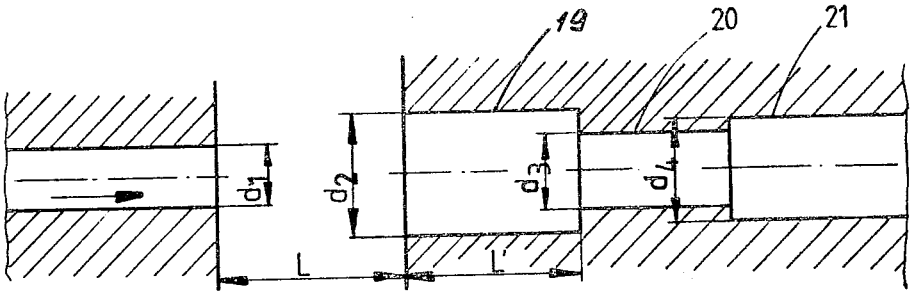
FIG. 11 shows another alternative form of the outlet channel.

In FIG. 11, the second part of the outlet channel is followed by a larger section 21 having a diameter $d_4$ which can e.g. be the same as $d_2$.

Figure 12:
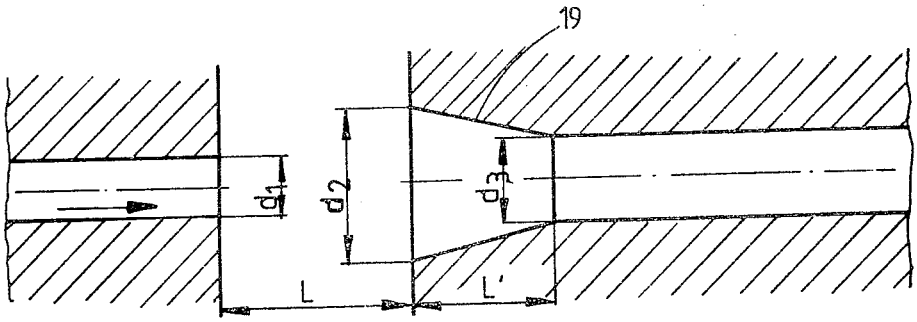
FIG. 12 shows a further alternative form of the outlet channel.

In FIG. 12, the first part of the outlet channel 19 is conical. In this case the lenght of the conical part must be such that $$\frac{d_3 - d_1}{2(L + L')} < \tan 7.5°.$$

What we claim is:

1. In a papermaking machine, a headbox system for dampening pressure fluctuations, which headbox system comprises an equalizing chamber communicating with an air space; a plurality of inlet channels flow connected with a supplier of pulp stock to deliver same into said equalizing chamber; and a plurality of outlet channels communicating with said equalizing chamber to receive said pulp stock for delivery therefrom; said outlet channels being disposed coaxially with respective inlet channels said inlet channels and outlet channels being of respective sizes and spaced-apart by a distance such that the pulp stock flows divergently from each inlet channel to the respective outlet channel across said equalizing chamber; the cross-sections of the inlet and outlet channels being circular, and related in diameter and inlet-to-outlet separation distance by the formula:

$$\frac{d_2 - d_1}{2L} > \tan 7.5°,$$

$d_2$=diameter of the outlet channels
$d_1$=diameter of the inlet channels
L=distance between the inlets and outlets.

2. A headbox system according to claim 1, wherein the outlet channels comprise a first part and a second part, said first part having a larger size than said second part.

3. A headbox system according to claim 2, wherein the cross-sections of the first and second parts of the outlet channels are circular, and are dimensioned in accordance with the formula:

$$\frac{d_2 - d_1}{2(L + L')} < \tan 7.5°,$$

$d_2$=diameter of the first part of the outlet channel
$d_1$=diameter of the inlet channel
L=distance between the inlet and outlets
L′=length of the first part of the outlet channel.

4. A headbox system according to claim 2, wherein the first part of the outlet channels is conical, and said inlet and outlet channels are dimensioned and spaced in accordance with the formula:

$$\frac{d_3 - d_1}{2(L + L')} < \tan 7.5°,$$

$d_3$=diameter of the second part of the outlet channel
$d_1$=diameter of the inlet channel
L=distance between the inlet and outlet channels
L′=length of the first part of the outlet channel.

* * * * *